US006705299B2

(12) United States Patent
Kienzler et al.

(10) Patent No.: US 6,705,299 B2
(45) Date of Patent: Mar. 16, 2004

(54) LEAK FUEL CONNECTION THAT CAN BE DESIGNED INDIVIDUALLY

(75) Inventors: Dieter Kienzler, Leonberg (DE); Udo Schaich, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/129,475

(22) PCT Filed: Aug. 28, 2001

(86) PCT No.: PCT/DE01/03275

§ 371 (c)(1),
(2), (4) Date: Jul. 29, 2002

(87) PCT Pub. No.: WO02/20977

PCT Pub. Date: Mar. 14, 2002

(65) Prior Publication Data

US 2003/0019463 A1 Jan. 30, 2003

(30) Foreign Application Priority Data

Sep. 5, 2000 (DE) ..... 100 43 627

(51) Int. Cl.[7] ..... F02B 37/04
(52) U.S. Cl. ..... 123/514; 123/506
(58) Field of Search ..... 123/514, 510–511, 123/506, 467

(56) References Cited

U.S. PATENT DOCUMENTS

| | | | | |
|---|---|---|---|---|
| 3,434,667 A | | 3/1969 | Chmura | |
| 3,680,782 A | * | 8/1972 | Monpetit et al. | 239/96 |
| 4,315,603 A | | 2/1982 | Nakajima et al. | |
| 4,709,679 A | * | 12/1987 | Djordjevic et al. | 123/506 |
| 4,826,081 A | * | 5/1989 | Zwick | 239/88 |
| 5,485,823 A | * | 1/1996 | Lintott et al. | 123/506 |
| 5,803,361 A | * | 9/1998 | Horiuchi et al. | 239/88 |
| 2001/0031207 A1 | * | 10/2001 | Maeda et al. | 417/298 |
| 2002/0088434 A1 | * | 7/2002 | Goodenough et al. | 123/446 |

FOREIGN PATENT DOCUMENTS

| | | |
|---|---|---|
| EP | 0 886 065 A | 12/1998 |
| GB | 2 149 453 A | 6/1985 |

* cited by examiner

*Primary Examiner*—Thomas N. Moulis
(74) *Attorney, Agent, or Firm*—Ronald E. Greigg

(57) ABSTRACT

The present invention relates to a leak fuel connection, in particular for a common rail system or a common rail injector, for connecting a leak fuel line via a connecting conduit to a connection end piece. The leak fuel connection, on the outer circumference of a component on which the leak fuel connection is provided, has an at least intermittently annularly embodied conduit, into which the connecting conduit for connecting to the leak fuel line discharges. The annular conduit is connected to the connection end piece via a connection element.

18 Claims, 3 Drawing Sheets

SECTION A-A

LEAK FUEL CONNECTION THAT CAN BE DESIGNED INDIVIDUALLY

CROSS-REFERENCE TO RELATED APPLICATIONS

This application is a 35 USC 371 application of PCT/DE 01/03275 filed on Aug. 28, 2001.

BACKGROUND OF THE INVENTION

1. Field of the Invention

The present invention relates to an individually adaptable leak fuel connection for a component that has a leak fuel line. In particular, the present invention relates to a leak fuel connection for a holder of an injector in a common rail system.

2. Description of the Prior Art

In FIGS. 10 and 11, a known leak fuel connection is shown. In a holder 18 for a common rail system, in which a piezoelectric element and a hydraulic booster are disposed (neither of them shown), the leak fuel connection is embodied such that a leak fuel line 2 communicates via a connecting conduit 3 directly with the connection end piece 4. As shown in FIG. 11, still other bores, namely a high-pressure bore 19 and a bore 20 for an electrical connection of the piezoelectric actuator are provided in the holder 18. Since these many bores are disposed in the holder 18 eccentrically to a center axis 0—0 of the holder 18, the connecting conduit 3 embodied as a transverse bore cannot extend in an arbitrary direction in the holder 18, because otherwise a communication with one of the bores 19, 20 could be made. Moreover, between the various bores, for the sake of high-pressure strength, minimum spacings must be adhered to so as to withstand the high pressures, in particular in a common rail system. Because of these circumstances, the connecting conduit 3 can accordingly not be disposed in an arbitrary direction in the holder 18. Because of this "rigid" leak fuel connection in the prior art, it is not possible to adapt the leak fuel connection individually to different vehicles. On the contrary, the leak fuel connection must be disposed in such a way that no communication with the bores provided in the holder 18 is created, or a minimum wall thickness of the various bores must be preserved. This greatly limits the disposition of the leak fuel connection.

The leak fuel connection of the prior art is thus adaptable only in a limited way to the most various engine compartment geometries of different vehicles or manufacturers. For this reason, a great number of different holders for piezoelectrically controlled injection systems already exist in order to meet the demands of a particular customer. The result is increased costs, since a great number of different parts have to be kept on hand, or different production processes must be performed.

SUMMARY OF THE INVENTION

The leak fuel connection of the invention has the advantage over the prior art that it can be disposed entirely flexibly on the component in which a leak fuel line is provided. By the provision of an at least intermittently annularly embodied conduit on the outer circumference of the component that has the leak fuel line, it can be assured that the leak fuel connection can be disposed at any arbitrary angle on the circumference of the component. To that end, the at least intermittently annularly embodied conduit communicates with the leak fuel line via a connecting conduit. The connecting conduit between the leak fuel line and the annular conduit can be disposed at an arbitrary point in the component. Via a connection element, a connection end piece of the leak fuel connection is then disposed on the annular conduit. This makes it possible, for different engines or different engine manufacturers, to adapt the leak fuel connection individually in terms of its length, angle and height. Thus according to the invention a flexible leak fuel connection is furnished that can be adapted to the most various geometries. Thus even when the engine compartment geometry is tight and installation conditions are also tight, the leak fuel connection can be disposed in an arbitrary position. Moreover, this leads to an additional unification of the component that has the leak fuel line, since the connecting conduit between the leak fuel line and the annular conduit can always be disposed at the same point. In particular, the flexible leak fuel connection of the invention is used in an injector unit in a common rail system for the leak fuel from a hydraulic booster for hydraulic boosting of a stroke of a piezoelectric element.

In a preferred feature of the present invention, the connection element that connects the annular conduit to the connection end piece is embodied as a flexible hose. This makes it possible for the hose to be rotated in arbitrary direction and at any arbitrary angle, so that the connection end piece of the leak fuel connection is disposed at a desired position. Especially preferably, the flexible hose is made from plastic.

In a further preferred feature of the present invention, the annular conduit is embodied as a completely encompassing annular groove, which extends along the outer circumference of the component. As a result, the connection element can be disposed at any desired point along the completely encompassing annular groove. The annular groove can have an arbitrary cross section. By means of the connecting conduit, the annular groove communicates with the leak fuel line. The component can thus be standardized with regard to the production steps necessary for the leak fuel connection.

To make a stop function and bracing of the connection end piece on the connection element possible, a support ring is preferably provided on the connection element. The support ring is disposed on the outer circumference of the connection element and is embodied for instance as a perforated disk, which is connected to the connection element by means of a press fit.

To enable protection of the annular conduit in subsequent machining steps, an inlay element is preferably provided, which is disposed around the annular conduit.

Preferably, a shoulder or an annular groove is provided for retaining the inlay element.

So that the inlay element can provide the annular conduit with an adequate sealing function, its sealing edge profile is embodied as a circular segment profile, sawtooth profile, pyramid profile, or a single or multiple hollow profile.

In a preferred feature of the present invention, the inlay element is embodied in two parts. One part is preferably embodied as a fabric inlay, and another part is embodied as a plastic inlay. The plastic inlay offers protection to the fabric inlay against external factors.

To enable a concluding fixation of the connection element and of the connection end piece secured to it, a plastic extruded sheath is provided in the region of the leak fuel connection. As a result, the leak fuel connection is retained in its desired final position, and protection against external factors is also afforded.

In order to use the smallest possible number of parts, the connection element and the connection end piece are preferably embodied integrally. Preferably, this integral component is made from plastic.

In another preferred feature of the present invention, the annular conduit can also be embodied such that it comprises a plurality of annular segments that are formed at different heights along the outer circumference and that communicate with one another via vertical connecting conduits.

BRIEF DESCRIPTION OF THE DRAWINGS

A plurality of exemplary embodiments of the invention are described in detail herein below, in conjunction with the drawings, in which.

DESCRIPTION OF THE PREFERRED EMBODIMENTS

Figure 1:
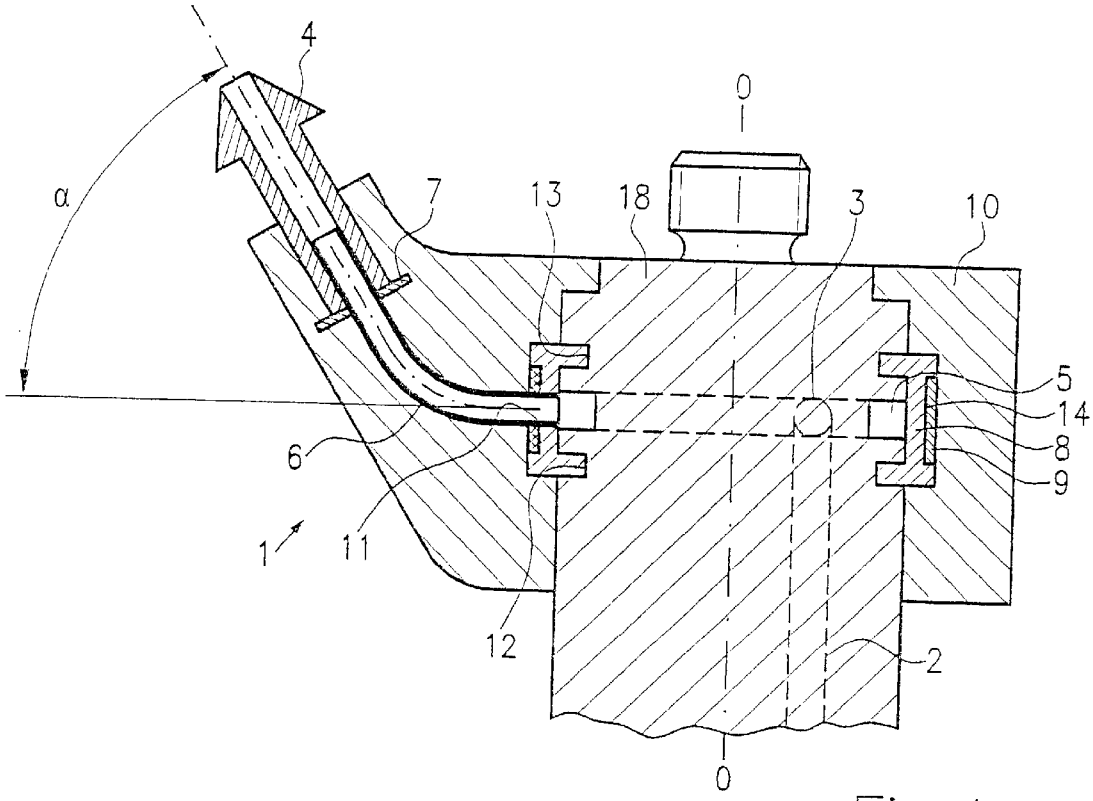
FIG. 1, a sectional view of a component with a leak fuel connection of the invention, in a first exemplary embodiment.

As shown in FIG. 1, the leak fuel connection 1 includes a connecting conduit 3, by way of which a leak fuel line 2 communicates with an annular conduit 5. The connecting conduit 3 is embodied as a transverse bore, at an angle of 90° to the leak fuel line 2. The annular conduit 5 in the first exemplary embodiment is embodied around the complete circumference of a holder 18. The holder 18 serves as a receiving element in a piezoelectrically controlled injector for a common rail system and within itself receives both a piezoelectric actuator and a hydraulic booster, neither of which are shown in FIG. 1. The leak fuel line 2 serves to receive leak fuel from the hydraulic booster.

The annular conduit 5 communicates via a connection element 6 with a connection end piece 4, on which a hose for draining off the leak fuel can for instance be mounted. The connection element 6 is embodied as a flexible hose and can be disposed at an arbitrary point along the completely encompassing annular conduit 5. A support ring 7 is also provided on the flexible connection element 6; the support ring is embodied as a perforated disk, and the connection element 6 is inserted through its center opening. The support ring 7 serves in particular to provide fixation in an injection-molding tool, in which once the leak fuel connection 1 has been installed the plastic extruded sheath 10 is made. Moreover, the support ring 7 acts as a stop for the nipple-like connection end piece 4 and thus has a support function for the connection end piece 4. The support ring 7 furthermore distributes the joining forces within the plastic. Preferably there is a press fit between the support ring 7 and the hoselike connection element 6. Thus the leak fuel connection can be disposed at an arbitrary angle $\alpha$.

To prevent leakage of leak fuel at the transition between the holder 18 and the plastic spray-coating 10, inlay elements 8 and 9 are also provided, which have a sealing function. The inlay element 8 is made from plastic and seals the annular conduit 5 off from both the escape of leak fuel and, in particular, from a penetration of plastic in the extruded sheath of the plastic housing 10. For the inlay element 8, a flexible, elastic plastic is preferably used.

Figure 2:
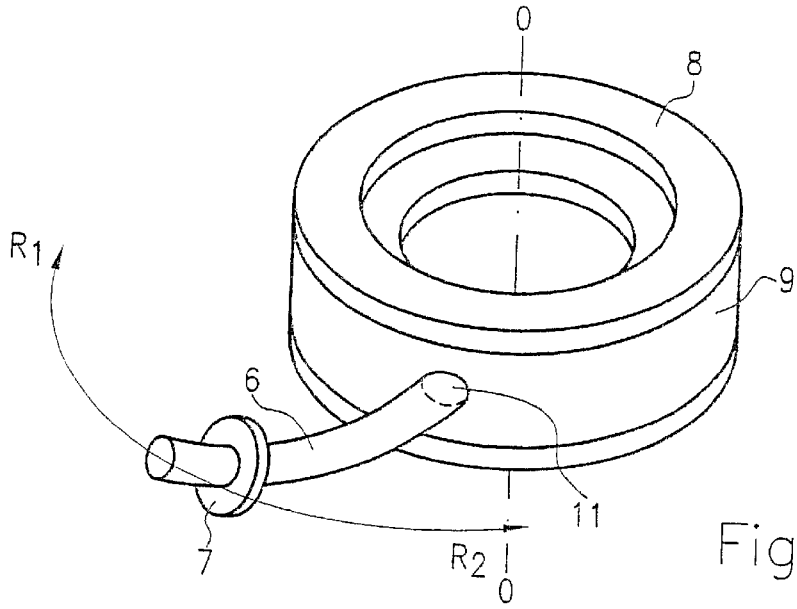
FIG. 2, a perspective view of an inlay element and of a connection element in the first exemplary embodiment.

The inlay element 9 is a fabric inlay and provides reinforcement in the back region of the inlay element 8 during forming of the extruded or spray formed sheath of the plastic housing 10. In particular, the inlay element 9 prevents the plastic inlay 8 from caving in. As FIGS. 1 and 2 show, the fabric inlay 9 is placed in a recess 14 on the outer circumference of the plastic inlay 8. The plastic inlay 8 in turn has two annularly encompassing protrusions, on the side toward the holder 18, that are disposed one in each of two grooves 12 and 13 formed in the holder 18, in order to hold the plastic inlay 8.

A through opening 11, which serves to receive the connection element 6, is also embodied in the two inlay elements 8 and 9. A press fit is preferably provided between the hoselike connection element 6 and the through opening 11 in the inlay elements 8 and 9. However, it is also possible for the hoselike connection element to be glued into the opening 11.

As indicated in FIG. 2 by the two arrows $R_1$ and $R_2$, the leak fuel connection can be disposed in an arbitrary direction, since the connection element 6 is designed to be flexible. Since the annular conduit 5 is embodied such that it extends extending all the way around the holder 18, the connection 11 for the hose 6 can also be positioned at an arbitrary point on the holder 18. It is thus possible to take the most various engine compartment geometries of different manufacturers into account and to dispose the leak fuel connection at the desired point in each case, using the same individual parts for all the different variants.

Figure 3:
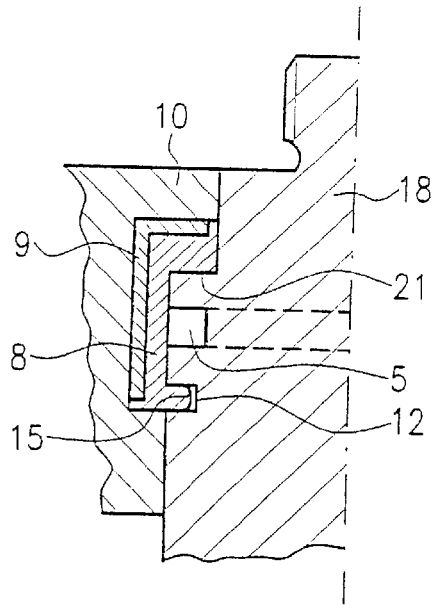
FIG. 3, a schematic fragmentary cross section through a leak fuel connection in a second exemplary embodiment of the present invention.

In FIG. 3, a leak fuel connection in a second exemplary embodiment of the present invention is shown. Identical or functionally identical parts are identified by the same reference numerals as in the first exemplary embodiment. Since the second exemplary embodiment is essentially equivalent to the first exemplary embodiment, only the differences are described in detail below.

As shown in FIG. 3, in the second exemplary embodiment, in contrast to the first exemplary embodiment, a shoulder 21 is provided on the holder 18, on which shoulder a protrusion of a plastic inlay 8 rests. Moreover, a groove 12 is embodied in the holder 18, serving to receive a protrusion with a sealing end face 15. The second inlay element 9 is embodied as L-shaped in section and is disposed on the outer circumference of the inlay 8. The second inlay 9 can be made from fabric, for instance, or steel and serves in particular to stabilize and protect the plastic inlay 8. This assures that the plastic inlay 8 will withstand the injection pressure during the extruded sheath of the plastic extruded sheath 10.

It should be noted that the annular groove 12 on the holder 18 can be omitted, if the contact pressure of the plastic inlay 8 is high enough. Such a contact pressure can be brought to bear for instance by means of the provision of a prestressed steel inlay in the plastic inlay 8. This assures that plastic cannot enter the annular conduit 5 during the extruded sheath of the housing 10.

Figure 4:
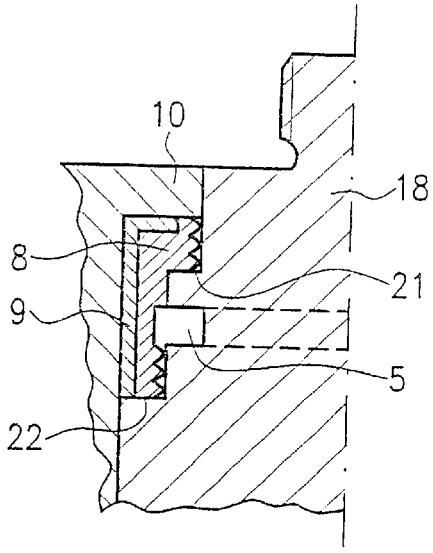
FIG. 4, a schematic fragmentary cross section through a leak fuel connection in a third exemplary embodiment of the present invention.

In FIG. 4, a leak fuel connection in a third exemplary embodiment of the present invention is shown. Identical or functionally identical parts are identified by the same reference numerals as in the second exemplary embodiment. Since the third exemplary embodiment is essentially equivalent to the second exemplary embodiment, only the differences are described in detail below.

As shown in FIG. 4, the holder 18 of the third exemplary embodiment has not only a first shoulder 21 but also a second shoulder 22. On this stepped holder 18, an annular conduit 5 is disposed between the two shoulders 21 and 22. For sealing and protecting the annular conduit 5 during the extrusion, once again a plastic inlay 8 and a fabric or steel inlay 9 are provided. Both inlays 8 and 9 are essentially L-shaped in section. As shown in FIG. 4, the shoulders 21 and 22 serve as sealing edges and as a stop for the inlay parts. This assures great tightness. Otherwise, the third exemplary embodiment corresponds to the exemplary embodiments described above, and so further description is dispensed with below.

Figure 5:
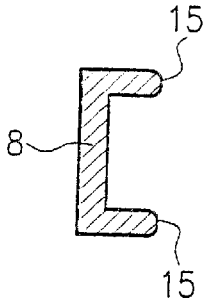
FIGS. 5–8, various sealing edge profiles of inlay elements for the leak fuel connection of the invention.
Figure 6:
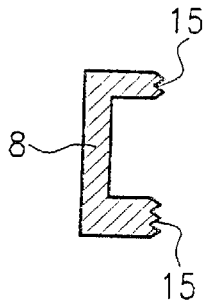
Figure 7:
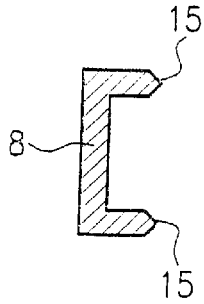
Figure 8:
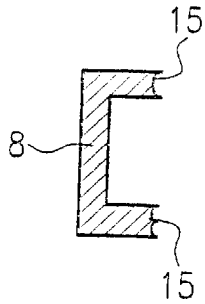

In FIGS. 5–8, different examples of inlay elements 8 with different sealing end faces 15 are shown. As shown in FIG. 5, the sealing end face 15 can for instance be embodied as a circular segment profile. In FIG. 6, a sawtooth profile is shown, and the number of individual sawteeth can be selected arbitrarily. FIG. 7 shows a sealing edge profile 15 in the form of a pyramid. FIG. 8 shows an inlay 8 with a hollow profile as the sealing edge profile 15; the hollow profile can be embodied as either single (upper part of the profile) or double (lower part of the profile). It should be noted that the sealing edge profiles shown in FIGS. 5–8 can also be used in combination.

Figure 9:
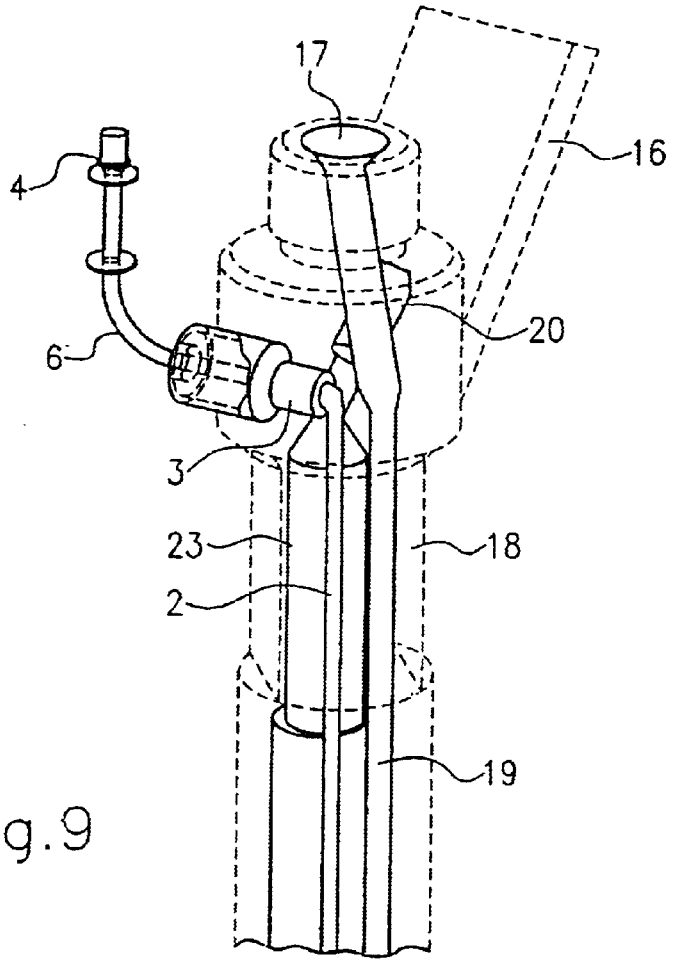
FIG. 9, a schematic, perspective illustration of the use of the leak fuel connection of the invention in a holder for a common rail system.
Figure 10:
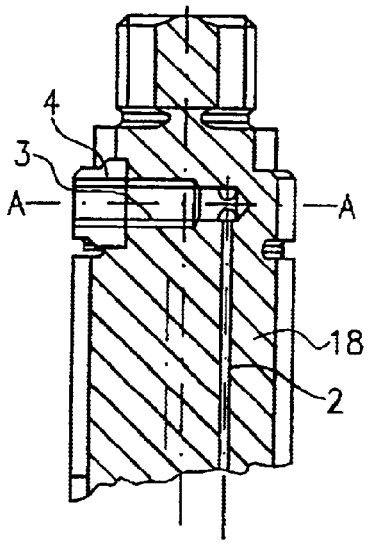
Fig.10 PRIOR ART
FIG. 10, a sectional side view of a holder for a piezoelectric injector of the prior art.
Figure 11:
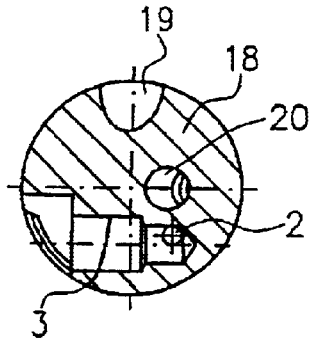
Fig.11 PRIOR ART
FIG. 11, a sectional view taken along the line A—A in FIG. 10.

FIG. 9 schematically and in perspective shows the disposition of the various bores in a holder 18 for a piezoelectric injector.

As shown in FIG. 9, a high-pressure bore 19 is provided, which communicates with a high-pressure connection 17. The holder 18 furthermore includes a bore 23 for receiving both a piezoelectric element and a hydraulic booster. The bore 23 communicates via a bore 20 with an electric connection 16 for the sake of electrically connecting the piezoelectric actuator. A leak fuel line 2 is also provided, which communicates with an annular conduit (not shown) via a connecting conduit 3. For diverting the leak fuel, a hoselike connection element 6 and a connection end piece 4 are disposed on the annular conduit, as described above, and after being installed are spray-coated with a plastic for the sake of fixation.

It should be noted that instead of the flexible, hoselike connection element 6, a rigid connection element can also be used. The flexibility of disposing the leak fuel connection 1 is restricted to only a slight extent thereby, since even a rigid connection element can be disposed at an arbitrary point on the annularly embodied conduit 5 and is rotatable about its fastening point on the holder 18.

It should also be noted that the connection element 6 and the connection end piece 4 can also be provided in the form of an integral element. In addition, the connecting conduit 3 for connecting the leak fuel line 2 to the annular conduit 5 can be provided in an arbitrary way, independently of the connection of the connection element 6.

It should also be noted that it is also possible not to provide the annular conduit 5 entirely annularly on the circumference, but instead to provide only a certain portion of the component with the annular conduit 5, the portion for instance being ¾ of the circumference, or the like. This would be sufficient especially whenever for various engine manufacturers the leak fuel connection must always be disposed on only a certain side of the component, for instance. In that case, the annular conduit 5 would have to be disposed only in that region of the component.

According to the invention, a leak fuel connection 1 is thus proposed which in comparison with the prior art, at only very slight effort and expense, can be positioned at an angle of practically 360° in an arbitrary position on a component that is to be provided with a leak fuel outlet. Even greater flexibility can be attained if a connection element of the leak fuel connection is made flexible, for instance comprising a rubber hose, a plastic hose, or a hose made up of multiple links.

Thus the present invention relates to a leak fuel connection, in particular for a common rail system or a common rail injector, for connecting a leak fuel line 2 to a connection end piece 4 via a connecting conduit 3. On an outer circumference of a component in which the leak fuel connection is provided, the leak fuel connection 1 has an at least intermittently annularly formed conduit, into which the connecting conduit 3 for connecting to the leak fuel line 2 discharges. The annular conduit 5 communicates with the connection end piece 4 via a connection element 6.

The above description of the exemplary embodiments of the present invention is intended solely for purposes of illustration and not for the sake of limiting the invention. Within the scope of the invention, various changes and modifications can be made without departing from the scope of the invention or its equivalent.

We claim:

1. A leak fuel connection for use in a common rail system or a common rail injector, for connecting a leak fuel line (2) via a connecting conduit (3) to a connection end piece (4), the leak fuel connection (1) comprising, an at least intermittently annular conduit (5) formed on the outer circumference of a component (18) on which the leak fuel connection (1) is provided, the connecting conduit (3) for connecting to the leak fuel line (2) discharging into the conduit (5), and a connection element (6) connecting the conduit (5) to the connection end piece (4).

2. The leak fuel connection of claim 1, wherein the connection element (6) is embodied as a flexible hose.

3. The leak fuel connection of claim 1, wherein the annular conduit (5) is embodied as a completely encompassing annular groove.

4. The leak fuel connection of claim 2, wherein the annular conduit (5) is embodied as a completely encompassing annular groove.

5. The leak fuel connection of claim 1, further comprising a support ring (7) disposed on the connection element (6), in order to form a stop for the connection end piece (4).

6. The leak fuel connection of claim 2, further comprising a support ring (7) disposed on the connection element (6), in order to form a stop for the connection end piece (4).

7. The leak fuel connection of claim 3, further comprising a support ring (7) disposed on the connection element (6), in order to form a stop for the connection end piece (4).

8. The leak fuel connection of claim 1, further comprising an inlay element (8, 9), which is disposed around the annular conduit (5).

9. The leak fuel connection of claim 3, further comprising an inlay element (8, 9), which is disposed around the annular conduit (5).

10. The leak fuel connection of claim 8, further comprising at least one shoulder (21, 22) and/or one groove (12, 13) provided for retaining the inlay element (8, 9).

11. The leak fuel connection of claim 9, further comprising at least one shoulder (21, 22) and/or one groove (12, 13) provided for retaining the inlay element (8, 9).

12. The leak fuel connection of claim 8, wherein the inlay element (8, 9) has as its sealing edge profile (15) a circular segment profile, a sawtoothed profile, a pyramid profile, or a single or multiple hollow profile, or an arbitrary combination of these profiles.

13. The leak fuel connection of claim 10, wherein the inlay element (8, 9) has as its sealing edge profile (15) a circular segment profile, a sawtoothed profile, a pyramid profile, or a single or multiple hollow profile, or an arbitrary combination of these profiles.

14. The leak fuel connection of claim 8, wherein the inlay element is formed of two inlays (8, 9), and the two inlays (8, 9) are made from different materials.

15. The leak fuel connection of claim 10, wherein the inlay element is formed of two inlays (8, 9), and the two inlays (8, 9) are made from different materials.

16. The leak fuel connection of claim 12, wherein the inlay element is formed of two inlays (8, 9), and the two inlays (8, 9) are made from different materials.

17. The leak fuel connection of claim 1, wherein the leak fuel connection, for fixation of the connection element (6) and the connection end piece (4), has a plastic extruded sheath (10).

18. The leak fuel connection of claim 1, wherein the connection element (6) and the connection end piece (4) are embodied integrally.

* * * * *